US007253770B2

(12) United States Patent
Yegin et al.

(10) Patent No.: US 7,253,770 B2
(45) Date of Patent: Aug. 7, 2007

(54) INTEGRATED GPS AND SDARS ANTENNA

(75) Inventors: Korkut Yegin, Grand Blanc, MI (US); Daniel G. Morris, Ovid, MI (US); Nazar F. Bally, Sterling Heights, MI (US); Randall J. Snoeyink, Clarkson, MI (US); William R. Livengood, Grand Blanc, MI (US)

(73) Assignee: Delphi Technologies, Inc., Troy, MI (US)

( * ) Notice: Subject to any disclaimer, the term of this patent is extended or adjusted under 35 U.S.C. 154(b) by 44 days.

(21) Appl. No.: 10/985,552

(22) Filed: Nov. 10, 2004

(65) Prior Publication Data

US 2006/0097924 A1 May 11, 2006

(51) Int. Cl.
*H01Q 1/38* (2006.01)

(52) U.S. Cl. ..... 343/700 MS; 343/713

(58) Field of Classification Search ..... 343/700 MS, 343/846, 848, 713, 711

See application file for complete search history.

(56) References Cited

U.S. PATENT DOCUMENTS

| | | | | |
|---|---|---|---|---|
| 5,548,297 | A * | 8/1996 | Arai | 343/700 MS |
| 5,952,971 | A * | 9/1999 | Strickland | 343/700 MS |
| 6,184,828 | B1 * | 2/2001 | Shoki | 342/372 |
| 6,597,316 | B2 * | 7/2003 | Rao et al. | 343/700 MS |
| 6,788,264 | B2 * | 9/2004 | Du | 343/725 |
| 6,809,686 | B2 * | 10/2004 | Du et al. | 343/700 MS |
| 2003/0164797 | A1 | 9/2003 | Ngai et al. | 343/700 |
| 2004/0051675 | A1 | 3/2004 | Inoue | 343/728 |
| 2004/0135728 | A1 * | 7/2004 | Komatsu et al. | 343/700 MS |
| 2004/0174304 | A1 | 9/2004 | Komatsu et al. | 343/700 |

FOREIGN PATENT DOCUMENTS

| | | |
|---|---|---|
| EP | 1 357 636 | 10/2003 |
| EP | 1357636 A | 10/2003 |

OTHER PUBLICATIONS

European Search Report dated Jan. 24, 2006.
EP 05 07 7514—European Search Report dated Jun. 22, 2006.
Chih-Ming Su et al, "A Dual-Band GPS microstrip antenna", Microwave and Optical Technology Letters Wiley USA, vol. 33, No. 4, May 20, 2002 pp. 238-240.
Sudha T. et al, "A dual band circularly polarized microstrip antenna on an EBG substrate", IEEE Antennas and Propagation Society International Symposium, 2002 Digest, APS. San Antonia, TX, Jun. 16-21, 2002, vol. 1 of 4, pp. 68-71.
Kwok L. Chung et al, "Effect of dielectric material tolerances on the performance of singly-fed circularly polarized stacked patch antennas", Antennas and Propagation Society Symposium, 2004; IEEE Monterey, CA., Jun. 20-25, 2004, vol. 1, pp. 479-482.
Bafrooei P. M. et al, "Characteristics of Single- and Double-Layer Microstrip Square-Ring Antennas", IEEE Transactions on Antennas and Propagation, Piscataway, NJ, vol. 47, No. 10, pp. 1633-1639, Oct. 1999.

* cited by examiner

*Primary Examiner*—Hoanganh Le
(74) *Attorney, Agent, or Firm*—Jimmy L. Funke

(57) ABSTRACT

An integrated patch antenna is disclosed. The integrated patch antenna receives at least a first and second band of signals. The integrated patch antenna includes a bottom metallization and first and second upper metallizations disposed about a dielectric material to receive the first and second signal bands. The first and second signal bands may be, for example, a satellite digital audio radio systems (SDARS) band and a global positioning system (GPS) band.

13 Claims, 3 Drawing Sheets

INTEGRATED GPS AND SDARS ANTENNA

TECHNICAL FIELD

The present invention generally relates to patch antennas. More particularly, the invention relates to an integrated patch antenna for reception of a first and second band of signals.

BACKGROUND OF THE INVENTION

It is known in the art that automotive vehicles are commonly equipped with audio radios that receive and process signals relating to amplitude modulation/frequency modulation (AM/FM) antennas, satellite digital audio radio systems (SDARS) antennas, global positioning system (GPS) antennas, digital audio broadcast (DAB) antennas, dual-band personal communication systems digital/analog mobile phone service (PCS/AMPS) antennas, Remote Keyless Entry (RKE) antennas, Tire Pressure Monitoring System antennas, and other wireless systems.

Currently, patch antennas are typically employed for reception and transmission of GPS [i.e. right-hand-circular-polarization (RHCP) waves] and SDARS [i.e. left-hand-circular-polarization (LHCP) waves]. Patch antennas may be considered to be a 'single element' antenna that incorporates performance characteristics of 'dual element' antennas that essentially receives terrestrial and satellite signals. SDARS, for example, offer digital radio service covering a large geographic area, such as North America. Satellite-based digital audio radio services generally employ either geo-stationary orbit satellites or highly elliptical orbit satellites that receive uplinked programming, which, in turn, is re-broadcasted directly to digital radios in vehicles on the ground that subscribe to the service. SDARS also use terrestrial repeater networks via ground-based towers using different modulation and transmission techniques in urban areas to supplement the availability of satellite broadcasting service by terrestrially broadcasting the same information. The reception of signals from ground-based broadcast stations is termed as terrestrial coverage. Hence, an SDARS antenna is required to have satellite and terrestrial coverage with reception quality determined by the service providers, and each vehicle subscribing to the digital service generally includes a digital radio having a receiver and one or more antennas for receiving the digital broadcast. GPS antennas, on the other hand, have a broad hemispherical coverage with a maximum antenna gain at the zenith (i.e. hemispherical coverage includes signals from 0° elevation at the earth's surface to signals from 90° elevation up at the sky). Emergency systems that utilize GPS, such as OnStar™, tend to have more stringent antenna specifications. Unlike GPS antennas, which track multiple satellites at a given time, SDARS patch antennas are operated at higher frequency bands and presently track only two satellites at a time.

Although other types of antennas for GPS and SDARS are available, patch antennas are preferred for GPS and SDARS applications because of their ease to receive circular polarization without additional electronics. Even further, patch antennas are a cost-effective implementation for a variety of platforms. However, because GPS antennas receive narrow-band RHCP waves, whereas, SDARS antennas receive LHCP waves with a broader frequency bandwidth, both applications are independent from each other, which has resulted in an implementation configuration utilizing a first patch antenna for receiving GPS signals and a second patch antenna for receiving SDARS signals.

Because multiple patch antennas are implemented for receiving at least a first and second band of signals, additional materials are required to build each patch antenna to receive each signal band. Additionally, the surface area and/or material of a single or multiple plastic housings that protects each patch antenna is increased due to the implementation of multiple patch antenna units, which, if mounted exterior to a vehicle on a roof, results in a more noticeable structure, and a less aesthetically-pleasing appearance.

Thus, cost and design complexity is increased when multiple patch antennas are implemented for reception of at least a first and second band of signals, such as, for example, GPS and SDARS signals. As such, a need exists for an improved antenna structure that reduces cost, materials, and design complexity.

SUMMARY OF THE INVENTION

The inventors of the present invention have recognized these and other problems associated with the implementation of multiple patch antennas for reception of at least a first and second band of signals. To this end, the inventors have developed an integrated patch antenna that receives at least a first and second band of signals. According to one embodiment of the invention, an integrated patch antenna includes a bottom metallization and first and second upper metallizations disposed about a dielectric material to receive the first and second signal bands.

According to another embodiment of the invention, an antenna for receiving GPS and SDARS signals comprises an integrated patch antenna including a bottom metallization, a first top metallization element, and a second top metallization element. The second top metallization is shaped as a substantially rectangular ring of material that encompasses the first top metallization that is shaped to include a substantially rectangular sheet of material. The first top metallization receives SDARS signals and the second top metallization receives GPS signals.

According to another embodiment of the invention, an antenna for receiving GPS and SDARS signals comprises an integrated patch antenna including a stacked metallization geometry defined by an upper metallization element, an intermediate metallization element, and a bottom metallization. The upper metallization receives SDARS signals and the intermediate metallization receives GPS signals.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
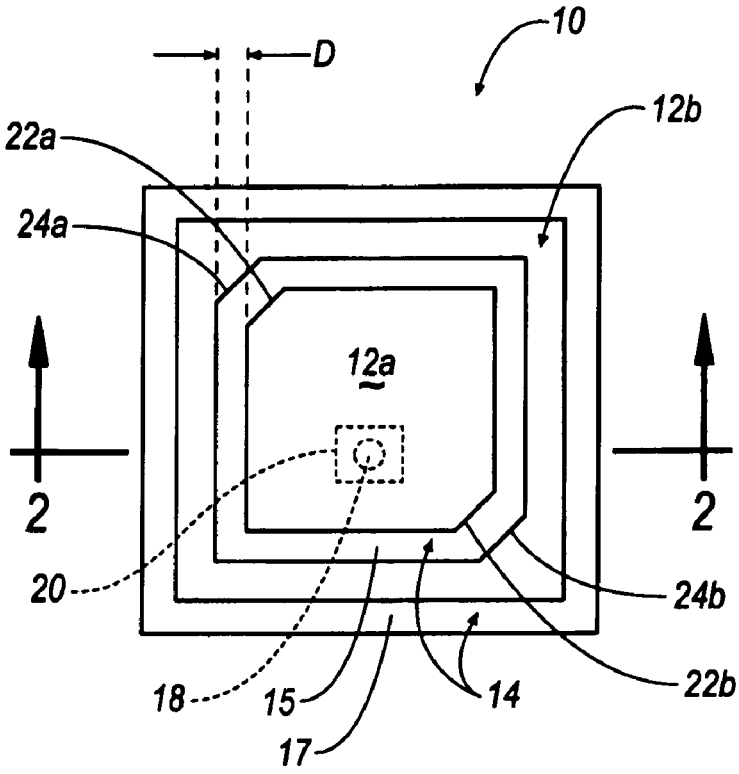
FIG. 1 is a top view an integrated patch antenna according to one embodiment of the invention.
Figure 3:
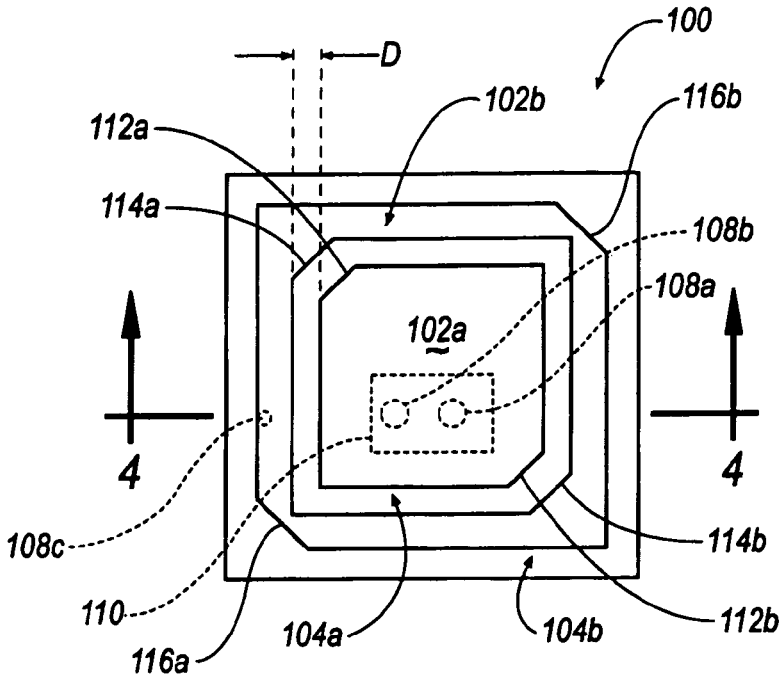
FIG. 3 is a top view of an integrated patch antenna according to another embodiment of the invention.

The above described disadvantages are overcome and a number of advantages are realized by an inventive integrated patch antenna, which is seen generally at 10 and 100 in FIGS. 1 and 3, respectively. According to one aspect of the invention, the integrated patch antenna 10, 100 receives global positioning system (GPS) and satellite digital audio radio system (SDARS) signals. Because both applications are independent from each other (i.e., GPS receives RHCP waves and SDARS receives LHCP waves), GPS and SDARS can be operated at the same time without interfering with each other's passive performance.

Figure 2A:
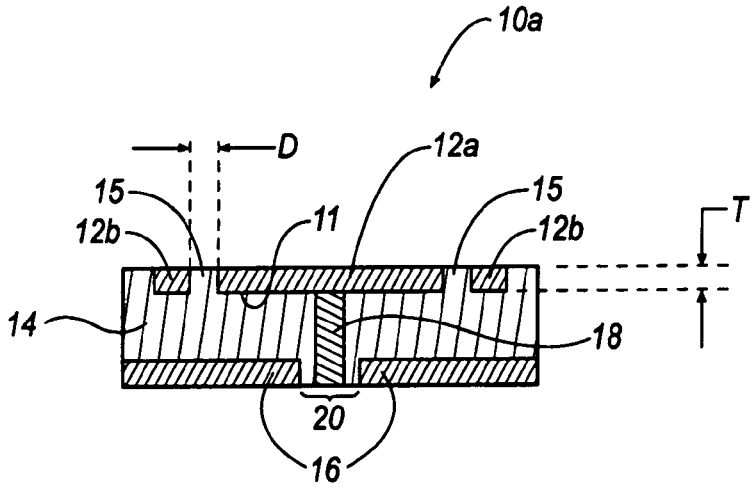
FIG. 2A is a cross-sectional view of the integrated patch antenna taken along line 2-2 of FIG. 1.
Figure 2B:
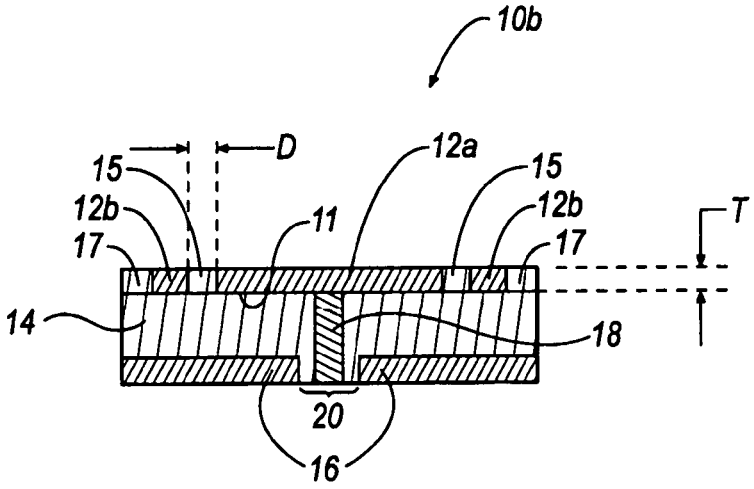
FIG. 2B is a cross-sectional view of the integrated patch antenna according to another embodiment of the invention taken along line 2-2 of FIG. 1.

According to the first embodiment of the invention as illustrated in FIGS. 1-2B, the integrated patch antenna 10 utilizes the same-plane metallization surface to receive at least a first and second band of signals, such as GPS and SDARS. As illustrated, the same-plane metallization surface includes a first top metallization element 12*a* and a second top metallization element 12*b* disposed over a top surface 11 of a dielectric material 14. The first top metallization 12*a* includes opposing cut corners 22*a*, 22*b*, which results in a LHCP polarized antenna element, and the second top metallization 12*b* includes straight-edge interior corners 24*a*, 24*b* (i.e. non-perpendicular corners), which results in a RHCP polarized antenna element. As seen in FIGS. 2A and 2B, a feed pin 18 is in direct contact with the first top metallization 12*a* and extends perpendicularly through the dielectric material 14 through an opening 20 formed in a substantially rectangular bottom metallization element 16. As illustrated, the dielectric material 14 isolates the feed pin 18 from contacting the bottom metallization element 16.

As seen more clearly in FIGS. 2A and 2B, the second top metallization 12*b* is shaped as a substantially rectangular ring of material that encompasses a substantially rectangular sheet of material that defines the first top metallization 12*a*. Each first and second top metallization 12*a*, 12*b* may be separated by a ring 15 of dielectric material that may be integral with the dielectric material 14 (as shown in FIG. 2A), which supports the first and second top metallizations 12*a*, 12*b*.

Although the first and second top metallizations 12*a*, 12*b* include a thickness, T, and are shown disposed in the top surface 11 the dielectric material 14, the first and second metallizations 12*a*, 12*b* may be placed over a top surface 11 of the dielectric material 14, and, as such, a separate ring 15 of dielectric material may be placed over the top surface 11 of the dielectric material 14, as shown in FIG. 2B. If configured as shown in FIG. 2B, an outer ring of dielectric material 17 may be placed over the top surface 11 to encompass an outer periphery of the second top metallization 12*b*.

Referring to FIGS. 1-2B, a distance, D, which is essentially the width of the inner dielectric ring 15, is defined as an electrical width that becomes larger at SDARS frequencies, which enables decoupling of the second top metallization 12*b* from the first top metallization 12*a*. In operation, when the frequency for the integrated patch antenna 10 is increased, the electrical width, in terms of wavelength, becomes larger, so as to decouple the second top metallization 12*b* from the first top metallization 12*a* at higher frequencies. Thus, decoupling of the first and second top metallizations 12*a*, 12*b* gives an advantage to the reception of frequencies related to the SDARS band. Essentially, when the integrated patch antenna 10 is adjusted to higher frequencies, the electrical width appears electrically longer. Conversely, if the frequency is decreased, the second top metallization 12*b* becomes more coupled to the first top metallization 12*a* at lower frequencies, which gives an advantage to the reception of frequencies related to the GPS band. During operation, the physical distance, D, remains constant as the electric width changes during frequency adjustments.

Figure 4:
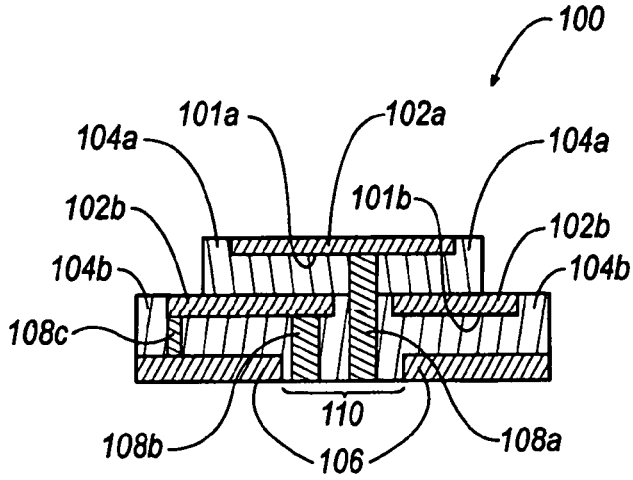
FIG. 4 is a cross-sectional view of the integrated patch antenna taken along line 4-4 of FIG. 3.

Referring now to FIGS. 3 and 4, another embodiment of the invention is directed to an integrated patch antenna 100 that utilizes a stacked metallization geometry. The stacked metallization geometry includes an upper metallization element 102*a*, an intermediate metallization element 102*b*, and a substantially rectangular bottom metallization element 106. As seen in FIG. 3, the upper metallization element 102*a* includes opposing cut corners 112*a*, 112*b*, which results in a LHCP polarized antenna element, and the intermediate metallization element 102*b* includes straight-edge interior corners 114*a*, 114*b* (i.e. non-perpendicular corners), which results in a RHCP polarized antenna element.

The upper metallization element 102*a* is disposed over or within a top surface 101*a* of an upper dielectric material 104*a*, and the intermediate metallization element 102*b* is disposed over or within a top surface 101*b* of a lower dielectric material 104*b* in a similar fashion as described with respect to FIGS. 2A and 2B. As illustrated, the substantially rectangular bottom metallization 106 is located under the lower dielectric material 104*b*. The integrated patch antenna 100 also comprises a pair of feed pins 108*a*, 108*b*, and a shorting pin 108*c*. As illustrated, each feed pin 108*a*, 108*b* extends perpendicularly from the upper metallization element 102*a* and the intermediate metallization element 102*b*, respectively, through an opening 110 formed in the substantially rectangular bottom metallization 106.

The upper metallization element 102*a* is resonant at SDARS frequencies and the intermediate metallization element 102*b* resonates at GPS frequencies. When tuned to receive SDARS frequencies, the upper metallization element 102*a* sees through the intermediate metallization element 102*b* such that the bottom metallization 106 is permitted to act as a ground plane for the upper metallization 102*a*. Conversely, when tuned to receive GPS frequencies, the upper metallization element 102*a* is phased-out such that the intermediate metallization element 102*b*, which includes a larger surface area and greater amount of material than the upper metallization 102*a*, becomes an upper antenna element.

In operation, the shorting pin 108*c*, which perpendicularly extends through the lower dielectric material 104*b*, connects the intermediate metallization element 102*b* to the bottom metallization 106 when the integrated patch antenna 100 receives SDARS frequencies. Essentially, the shorting pin 108*c* shorts-out the intermediate metallization 102*b* so that the bottom metallization 106 becomes the ground plane for the upper metallization 102*a*. The shorting pin 108*c* is located at an outer-most edge of the intermediate metallization 102*b* so as not to interfere with the feed pins 108*a*, 108*b*, which are located substantially proximate a central area of the integrated patch antenna 100. Intermediate metallization element 102*b* includes opposing cut corners 116*a* and 116*b*. An outer dielectric ring having a width, D, circumscribes upper metallization element 102*a*.

Accordingly, the integrated patch antenna element 10, 100 receives at least a first and a second band of signals, such as GPS and SDARS signals. Each integrated patch antenna 10, 100 is immune to vertical coupling of electric fields, which makes each antenna design immune to cross-polarization fields because GPS antennas receive narrowband RHCP waves, whereas, SDARS antennas receive LHCP waves with a broader frequency bandwidth. Additionally, the number of individual antennas employed, for example, on a vehicle, may be reduced. For example, vehicles employing a quad-band system that includes a cell phone antenna operating on two bands, such as PCS and AMPS, along with a geo-positioning band, such as GPS, and a digital radio band, such as SDARS may include two antennas rather than a conventional three antenna quad-band implementation. As a result, the present invention provides an improved antenna structure that reduces cost, materials, and design complexity.

The present invention has been described with reference to certain exemplary embodiments thereof. However, it will be readily apparent to those skilled in the art that it is possible to embody the invention in specific forms other than those of the exemplary embodiments described above. This may be done without departing from the spirit of the invention. The exemplary embodiments are merely illustrative and should not be considered restrictive in any way. The scope of the invention is defined by the appended claims and their equivalents, rather than by the preceding description.

What is claimed is:

1. An antenna for receiving a first and second signal band comprising:

an integrated patch antenna including a bottom metallization; and first and second upper metallizations disposed about a dielectric material to receive the first and second signal bands, wherein the first and second upper metallizations are a first top metallization element and a second top metallization element, wherein the second top metallization is shaped as a substantially rectangular ring of material that encompasses the first top metallization that is shaped to include a substantially rectangular sheet of material, and wherein the first top metallization includes opposing cut corners, and the second top metallization includes non-perpendicular interior corners.

2. The antenna according to claim 1, wherein the first band relates to global positioning system (GPS) signals and the second band relates to satellite digital audio radio system (SDARS) signals.

3. The antenna according to claim 1, wherein a feed pin is in direct contact with the first top metallization and extends perpendicularly through the dielectric material through an opening formed in the bottom metallization.

4. The antenna according to claim 1, wherein the first and second top metallization elements are separated by a ring of dielectric material.

5. The antenna according to claim 4, wherein an outer ring of dielectric material encompasses an outer periphery of the second top metallization.

6. The antenna according to claim 4, wherein an electrical width, referenced by a physical distance defined as the width of the ring of dielectric material becomes larger when the integrated patch antenna is tuned to frequencies related to the first signal band, and conversely, becomes smaller when the integrated patch antenna is tuned to frequencies related to the second signal band.

7. An antenna for receiving a first and second signal band comprising:

an integrated patch antenna including a bottom metallization; and first and second upper metallizations disposed about a dielectric material to receive the first and second signal bands, wherein the first and second upper metallizations are stacked metallization geometry including an upper metallization element, and an intermediate metallization element, and wherein said bottom metallization element is substantially rectangular, and wherein the upper metallization element includes opposing cut corners, and the intermediate metallization element includes non-perpendicular interior corners.

8. The antenna according to claim 7, wherein the first and second upper metallizations are a first top metallization element and a second top metallization element, wherein the second top metallization is shaped as a substantially rectangular ring of material that encompasses the first top metallization that is shaped to include a substantially rectangular sheet of material.

9. The antenna according to claim 7, wherein the dielectric material further comprises an upper dielectric material and a lower dielectric material.

10. The antenna according to claim 7, wherein the integrated patch antenna includes a first feed pin a second feed pin, and a shorting pin, wherein the first feed pin extends perpendicularly from the upper metallization element and the second feed pin extends from the intermediate metallization element through an opening formed in the substantially rectangular bottom metallization.

11. The antenna according to claim 10, wherein when the integrated patch antenna is tuned to frequencies related to the first signal band, the upper metallization element sees through the intermediate metallization element such that the bottom metallization is permitted to act as a ground plane for the upper metallization, and conversely, when the integrated patch antenna is tuned to frequencies related to the second signal band, the upper metallization element is phased-out such that the intermediate metallization element becomes an upper antenna element.

12. The antenna according to claim 11, wherein the shorting pin connects the intermediate metallization element to the bottom metallization to shorts-out the intermediate metallization when the integrated patch antenna is tuned to frequencies related to the first signal band.

13. The antenna according to claim 7, wherein the first band relates to global positioning system (GPS) signals and the second band relates to satellite digital audio radio system (SDARS) signals.

* * * * *